US006357871B1

(12) United States Patent
Ashida et al.

(10) Patent No.: US 6,357,871 B1
(45) Date of Patent: Mar. 19, 2002

(54) INK JET RECORDING MEDIUM, APPARATUS FOR PREPARING AN INK JET PRINTED PRODUCT, AND INK JET PRINTED PRODUCT

(75) Inventors: Tetsuya Ashida; Tomoko Ishimaru; Takao Senga; Sadao Kuriu; Shigehiko Miyamoto, all of Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 09/450,125

(22) Filed: Nov. 26, 1999

(30) Foreign Application Priority Data

Nov. 27, 1998 (JP) ..... 10-336877
Jan. 13, 1999 (JP) ..... 11-006001

(51) Int. Cl.[7] ..... B41J 3/407

(52) U.S. Cl. ..... 347/106; 347/105; 347/101; 347/102

(58) Field of Search ..... 347/105, 101, 347/106, 102; 429/195; 219/216

(56) References Cited

U.S. PATENT DOCUMENTS 5,021,318 A * 6/1991 Mayo et al. ..... 156/235
5,478,414 A * 12/1995 Mozelewski et al. ..... 156/325
5,764,263 A * 6/1998 Lin ..... 347/101

FOREIGN PATENT DOCUMENTS

| | | | |
|---|---|---|---|
| DE | 196 28 342 C2 | 1/1998 | |
| EP | 0 575 644 B1 | 12/1993 | |
| JP | 58097330 | 5/1983 | |
| JP | 59222381 A * | 12/1984 | ..... 428/142 |

OTHER PUBLICATIONS

German Official Action Dated Aug. 6, 2001.

* cited by examiner

*Primary Examiner*—John Barlow
*Assistant Examiner*—Manish Shah
(74) *Attorney, Agent, or Firm*—Oblon, Spivak, McClelland, Maier & Neustadt, P.C.

(57) ABSTRACT

An ink jet recording medium which comprises a support and a layer comprising fine particles of a thermoplastic organic polymer, formed on at least one side of the support, so that said fine particles of a thermoplastic organic polymer are dissolved or melted after ink jet recording to form a layer wherein said fine particles of a thermoplastic organic polymer are fused to one another, wherein said fine particles of a thermoplastic organic polymer have an average particle size within a range of from 1 to 20 $\mu$m.

13 Claims, 5 Drawing Sheets

INK JET RECORDING MEDIUM, APPARATUS FOR PREPARING AN INK JET PRINTED PRODUCT, AND INK JET PRINTED PRODUCT

BACKGROUND OF THE INVENTION

1. Field of the Invention

The present invention relates to an ink jet recording medium suitable for printing with an ink jet recording ink and an apparatus for its treatment, as well as a printed product prepared by the treatment. By the present invention, it is possible to obtain an ink jet printed product which not only is free from printing irregularities or bleeding, but also has a high gloss and which is excellent also in water resistance, light resistance and scratch resistance.

2. Discussion of Background

Ink jet recording has been widely used in recent years as it is free from noise, capable of printing at a high speed and useful for e.g. terminal printers. Further, by using a plurality of ink nozzles, multicolor recording can thereby be easily carried out, and multi ink jet recording by various types of ink jet recording systems is practically carried out. Particularly, an attention has been drawn to an ink jet printer which is capable of accurately forming a complicated image at a high speed, as an output device for image information of e.g. letters or various designs prepared by computers and photographs. Application fields of ink jet printers which have been of particular interest in recent years, include, for example, large posters, displays, flags, etc. which can easily be prepared by means of large size ink jet plotters.

Ink jet recording media to be used in these fields are required to be not only of high quality but also aesthetically excellent and further, when used as e.g. large size posters for outdoor display, they are required to have excellent weather resistance and water resistance.

In an effort to satisfy such requirements, various improvements have been proposed from both aspects of the ink and the recording media.

In an ink jet recording system, it has been common to employ an ink having a dye or pigment dissolved or dispersed in an aqueous or organic solvent. Most popular is a water-soluble dye ink having various water-soluble dyes dissolved in water or in a mixture of water and an organic solvent. Such a water-soluble dye ink is excellent for the maintenance of an ink jetting head of an ink jet recording apparatus and excellent also in the color developing property or resolution after printing. However, it brings about a problem in water resistance of a recorded image, as it is water-soluble. Further, a water-soluble dye is poor in weather resistance by its nature (color change or fading of an image due to light, ozone, $SO_x$, $NO_x$, temperature or humidity), and accordingly, when the recording medium is displayed outdoor, there will be a drawback that the image undergoes color fading or color change quickly.

In order to overcome such drawbacks, many proposals have been made for recording sheets and recording methods so that a resin layer is provided on a porous ink-absorbing layer containing a pigment, and the resin layer is fused after printing with a water-soluble dye ink. JP-B-2-31673 discloses a combination of a pigment layer and a heat melting layer, and JP-A-8-2090, JP-A-9-104163 and JP-A-9-104164 propose a combination of a heat melting layer and a pigment layer employing an alumina hydrate. As a method for fusing the heat meltable resin layer after printing, various methods may be mentioned such as pressing it against a heated drum such as a ferrotype drier to be used for drying baryta photographic base paper, or passing it between a pair of rolls for pressing and heating. However, it is most common to press it against a heated flat metal roll for fusion. By this fusing treatment, a heat meltable resin layer is formed to secure water resistance, weather resistance, gloss or transparency. However, the performance is still inadequate, and further improvements have been desired. Further, the average particle size of the fine particles of the heat meltable organic polymer contained in the heat melting layer is fine, whereby the ink permeability is poor, and with respect to the printing property, a drawback such as flooding or bleeding of ink has not yet been completely overcome. Especially, there has been a problem that if it is tried to obtain adequate water resistance, scratch resistance of the surface of the recording medium tends to deteriorate.

SUMMARY OF THE INVENTION

It is an object of the present invention to provide an ink jet printed product which fully satisfies scratch resistance, light resistance, water resistance, an elimination of printing irregularities or bleeding, an apparatus for its preparation, and an ink jet recording medium suitable therefor.

One object of the present invention has been accomplished by an ink jet recording medium having the following structures.

1. An ink jet recording medium which comprises a support and a layer comprising fine particles of a thermoplastic organic polymer, formed on at least one side of the support, so that said fine particles of a thermoplastic organic polymer are dissolved or melted after ink jet recording to form a layer wherein said fine particles of a thermoplastic organic polymer are fused to one another, wherein said fine particles of a thermoplastic organic polymer have an average particle size within a range of from 1 to 20 $\mu$m.
2. The ink jet recording medium according to Item 1, wherein an ink-absorbing layer comprising an inorganic pigment, is formed between the support and the layer comprising fine particles of a thermoplastic organic polymer.
3. The ink jet recording medium according to Item 2, wherein said inorganic pigment comprises a pigment having an average secondary particle size of at least 1 $\mu$m and less than 5 $\mu$m and a pigment having an average secondary particle size of at least 5 $\mu$m.
4. The ink jet recording medium according to any one of Items 1 to 3, wherein the layer comprising fine particles of a thermoplastic organic polymer, contains colloidal silica.
5. The ink jet recording medium according to any one of Items 1 to 4, wherein the layer comprising fine particles of a thermoplastic organic polymer, contains a release agent.
6. The ink jet recording medium according to any one of Items 1 to 5, wherein said fine particles of a thermoplastic organic polymer are of a polyolefin resin.
7. The ink jet recording medium according to any one of Items 1 to 6, wherein the support is a waterproof support.

Another object of the present invention is accomplished by an apparatus for preparing an ink jet printed product having the following structures.

8. An apparatus for preparing an ink jet printed product, whereby, after carrying out ink jet recording on an ink jet recording medium which comprises a support and a layer comprising fine particles of a thermoplastic organic polymer, formed on at least one side of the support, said fine particles of a thermoplastic organic polymer are dissolved or melted to form a layer wherein said fine particles of a thermoplastic organic polymer are fused to one another, which comprises a step of heating the layer comprising fine particles of a thermoplastic organic polymer, and an impressing step of passing the recording medium between a pair of press rolls while the layer comprising fine particles of a thermoplastic organic polymer is still in a plastic state after the heating step, to transfer a shape of the roll surface to the layer.

9. The apparatus for preparing an ink jet printed product according to Item 8, wherein the temperature of the roll surface which contacts the layer comprising fine particles of a thermoplastic organic polymer in the impressing step, is lower than the temperature in the heating step.
10. The apparatus for preparing an ink jet printed product according to Item 8, wherein the heating step is a step of heating to a temperature of at least the minimum film-forming temperature (MFT) of said fine particles of a thermoplastic organic polymer, and the temperature of the roll surface in the impressing step is a temperature lower than MFT.
11. The apparatus for preparing an ink jet printed product according to any one of Items 8 to 10, wherein the heating means in the heating step is of a type to heat from the rear side of the support by a heat conduction system.
12. The apparatus for preparing an ink jet printed product according to any one of Items 8 to 10, wherein the heating means in the heating step is of a type to heat from the side of the layer comprising fine particles of a thermoplastic organic polymer by a radiation conduction system.
13. The apparatus for preparing an ink jet printed product according to any one of Items 8 to 10, wherein the heating means in the heating step is of a type to heat from the side of the layer comprising fine particles of a thermoplastic organic polymer by a convective heat transfer system.
14. The apparatus for preparing an ink jet printed product according to any one of Items 8 to 13, wherein the roll surface which contacts the layer comprising fine particles of a thermoplastic organic polymer in the impressing step, is a mirror-finished surface, a roughened surface or a surface having a patterned engraving.

Still another object of the present invention has been accomplished by an ink jet printed product having the following structure.

15. An ink jet printed product obtained by carrying out ink jet recording on an ink jet recording medium as defined in any one of Items 1 to 7, followed by treatment by an apparatus for preparing an ink jet printed product as defined in any one of items 8 to 14.

DETAILED DESCRIPTION OF THE PREFERRED EMBODIMENTS

Figure 1:
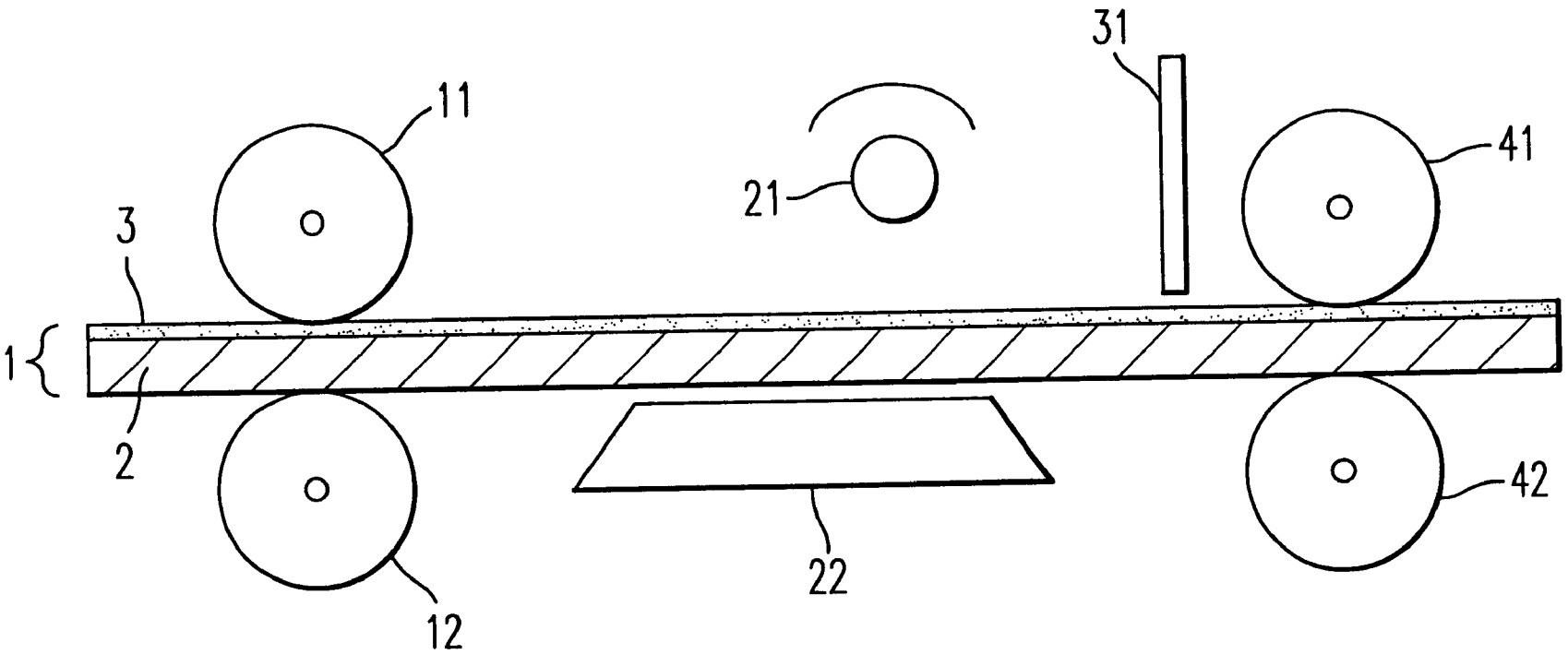
FIG. 1 is a schematic view illustrating an embodiment of the apparatus for preparing an ink jet printed product of the present invention (combined use of a heat conduction system and a radiation conduction system).

Now, the present invention will be described in detail with reference to the preferred embodiments.

The ink jet recording medium to be used in the present invention comprises a support and a layer comprising fine particles of a thermoplastic organic polymer, formed on the support, wherein said fine particles of a thermoplastic organic polymer have an average particle size within a range of from 1 to 20 $\mu$m. It is preferred that a separate ink-absorbing layer is present between the support and the layer comprising fine particles of a thermoplastic organic polymer. However, in a case where the support is one having an ink-absorbing ability such as paper, or in a case where the layer comprising fine particles of a thermoplastic organic polymer has a sufficient ink-absorbing ability, such a separate ink-absorbing layer may not be present.

In the present invention, it is preferred that the layer comprising fine particles of a thermoplastic organic polymer is present at the outermost surface, and after printing, this layer comprising fine particles of a thermoplastic organic polymer, is dissolved or melted by a solvent or heating to form a film, whereby water resistance can be obtained.

In the present invention, the average particle size of the fine particles of a thermoplastic organic polymer is within a range of from 1 to 20 $\mu$m. If the average particle size of the fine particles of a thermoplastic organic polymer is smaller than 1 $\mu$m, the ink absorptivity tends to be poor, part of the ink tends to remain in the layer and adversely affect the film-forming property, whereby no adequate water resistance tends to be obtained. If the average particle size of the fine particles of a thermoplastic organic polymer exceeds 20 $\mu$m, no adequate film-forming property can be obtained when the fine particles of a thermoplastic organic polymer are dissolved or melted for fusion, whereby the gloss tends to decrease, or the water resistance tends to deteriorate, although the ink absorptivity will be good. In order to form the film more uniformly, it is preferred to employ fine particles of a thermoplastic organic polymer having an average particle size of from 3 to 10 $\mu$m. Further, fine particles of a thermoplastic organic polymer having various particle sizes may be used in combination as a mixture, but it is necessary that the fine particles contain at least 50 wt % of fine particles having an average particle size within a range of from 1 to 20 $\mu$m.

In the present invention, the coating amount of the layer comprising fine particles of a thermoplastic organic polymer is preferably from 1 to 50 g/m$^2$ as solid content. Further, in a case where no ink-absorbing layer is formed beneath the layer of fine particles, the coating amount (dried solid content) is preferably from 5 to 50 g/m$^2$ in such a case, the layer comprising fine particles of a thermoplastic organic polymer serves also as a layer for holding a colorant in the ink, while the base paper layer serves as a layer for absorbing the solvent in ink, whereby the coating amount is set to be at least 5 g/m$^2$ to secure the ink absorptivity and the ability of holding the colorant in ink. If the coating amount of the layer comprising fine particles of a thermoplastic organic polymer is less than 1 g/m$^2$, film-forming tends to be inadequate when the particles are dissolved of melted for fusion, and the gloss and water resistance tend to deteriorate. On the other hand, if it exceeds 50 g/m$^2$, not only the printing property tends to be poor, but also a part of ink will not reach the ink-absorbing layer and remain in the layer comprising fine particles of a thermoplastic polymer, and it thus adversely affects against formation of a uniform film, and the water resistance tends to deteriorate, such being undesirable. The thicker the layer comprising fine particles of a thermoplastic organic polymer, the better the water resistance, but the ink permeability tends to be poor. Accordingly, it is advisable to make the layer thick by increasing the size of the fine particles of the organic polymer.

In the present invention, the layer comprising fine particles of a thermoplastic organic polymer, may contain a small amount of a water-soluble binder or a polymer latex having a low MFT (e.g. at most 30° C.) as a binder to obtain an adhesive property after coating. The content is usually from about 1 to 30 wt %, preferably from 2 to 20 wt %, based on the fine particles of a thermoplastic organic polymer. If the content of the binder increases, the water resistance tends to remarkably decrease, such being undesirable. As a preferred binder, polyvinyl alcohol may be mentioned. As the fine particles of a thermoplastic organic polymer, an olefin homopolymer or copolymer, such as polyethylene, polypropylene, polyisobutylene, polyethylene wax, polyethylene oxide, polytetrafluoroethylene, an ethylene-acrylic acid copolymer, an ethylene-ethyl acrylate copolymer or an ethylene-vinyl acetate copolymer, or a derivative thereof, such as a polyolefin type resin, a polyvinyl chloride, a vinyl chloride-vinyl acetate copolymer, a vinyl chloride-acrylate copolymer, polyvinylidene chloride, styrene-butadiene rubber or NBR rubber, may, for example, be mentioned. From the viewpoint of handling efficiency, film-forming property, film strength, gloss, etc., it is preferred to employ a polyolefin type resin in the present invention. Further, fine particles of various other thermoplastic organic polymers may be mixed to this polyolefin type resin.

In the present invention, the minimum film-forming temperature (MFT) of the fine particles of a thermoplastic organic polymer is preferably within a range of from 40 to 150° C. The minimum film-forming temperature is meant for the minimum temperature required for the fine particles of a thermoplastic organic polymer to form a film. This minimum film-forming temperature can be measured by a temperature gradient method as disclosed, for example, in "Chemistry of Polymer Latex" edited by Soichi Muroi (1997). If the minimum film-forming temperature of the fine particles of a thermoplastic organic polymer is lower than 40° C., the fine particles of a thermoplastic organic polymer tend to undergo film formation in a usual process for production of an ink jet recording medium, whereby the ink absorptivity deteriorates. On the other hand, from the viewpoint of the drying efficiency, it tends to be difficult to produce an ink jet recording medium at a temperature at which the fine particles of a thermoplastic organic polymer will not undergo film formation. If the minimum film-forming temperature of the fine particles of a thermoplastic organic polymer exceeds 150° C., no adequate heat quantity can be obtained by a usual heat treatment, and it tends to be difficult to carry out film formation uniformly, whereby the gloss tends to deteriorate, and the water resistance tends to be low. On the other hand, if the temperature is raised to a level of at least the minimum film-forming temperature in order to attain uniform film formation, the water-proof support tends to be deformed or impaired by the heat, whereby the gloss tends to deteriorate, and the flatness tends to be low, such being undesirable. Further, to optimize the film-forming efficiency, the uniformity of the film and the strength of the film, the minimum film-forming temperature (MFT) of the fine particles of a thermoplastic organic polymer in the present invention is more preferably within a range of from 60 to 130° C.

In the present invention, the average particle size of the fine particles of a thermoplastic organic polymer is from 1 to 20 $\mu$m. However, during the heat fusion treatment, not all particles will participate in the uniform film-formation, and a part thereof will remain in the state of particles and will weaken the film strength. Further, even when a completely uniform film is formed, the film strength may sometimes be weak depending upon the type of the resin. Therefore, it is preferred to incorporate colloidal silica to the layer comprising the fine particles of a thermoplastic organic polymer, in order to improve the scratch resistance. The colloidal silica to be used here is preferably one having an average particle size of from 0.03 to 0.1 $\mu$m. If the average particle size of the colloidal silica is smaller than 0.03 $\mu$m, film formation may take place during drying, whereby the ink absorptivity tends to deteriorate. On the other hand, if the average particle size of colloidal silica exceeds 0.1 $\mu$m, it tends to protrude from the film layer when the fine particles of a thermoplastic organic polymer are dissolved or melted for fusion, whereby the gloss tends to deteriorate, such being undesirable.

In the present invention, the amount of colloidal silica is preferably at most 50 wt %, based on the fine particles of a thermoplastic organic polymer. If the amount of colloidal silica exceeds 50 wt %, it tends to protrude from the film layer when the fine particles of a thermoplastic organic polymer are dissolved or melted for fusion, whereby the gloss tends to deteriorate, and the ink absorptivity tends to deteriorate, such being undesirable.

In the present invention, the layer comprising fine particles of a thermoplastic organic polymer may contain, in addition to the fine particles of a thermoplastic organic polymer and colloidal silica, a heat fusion material, for example, a natural wax such as carnauba wax, ouricury wax, candelilla wax, rice wax, Japan wax, bees wax, lanolin, spermaceti, montan wax, ozokerite, ceresin, paraffin max, microcrystalline wax or petrolatum, or its derivative, a surfactant such as sorbitan stearate, propylene glycol monostearate, glycerol stearate or polyoxyethylene stearate, a higher fatty acid or its metal salt such as lauric acid, palmitic acid, myristic acid, stearic acid, behenic acid, aluminum stearate, lead stearate, barium stearate, zinc stearate, zinc palmitate, methylhydroxy stearate or glycerol monohydroxy stearate, or its derivative such as an amide ester, as the case requires. Further, these materials may serve effectively as a release agent, a film formation improver or an apparent minimum film-forming temperature reducing agent at the time of dissolving or melting the fine particles of a thermoplastic organic polymer for fusion.

Further, the layer comprising the fine particles of a thermoplastic organic polymer may further contain an inorganic pigment such as amorphous porous silica, calcium carbonate, talc, clay, kaolin, calcium sulfate, barium sulfate, titanium oxide, zinc oxide, aluminum silicate, magnesium silicate or calcium silicate, as the case requires. In such a case, the amount of the inorganic pigment is preferably at most 30 wt %, based on the fine particles of a thermoplastic organic polymer.

In the present invention, the layer comprising fine particles of a thermoplastic organic polymer contains the fine particles of a thermoplastic organic polymer in an amount of at least 50 wt %, preferably at least 70 wt %, as the solid content.

In the present invention, in an embodiment wherein a separate ink-absorbing layer is provided beneath the layer comprising fine particles of a thermoplastic organic polymer, a porous layer containing an inorganic or organic pigment as the main component, is used. Particularly preferably, a layer containing a porous pigment is employed. As the porous pigment, a known organic or inorganic pigment may be employed. Usually, inorganic fine particles are employed. For example, synthetic amorphous silica produced by a wet system, fine alumina hydrate or colloidal silica may preferably be employed.

In the present invention, a particularly preferred ink-absorptivity can be obtained when a pigment having an average secondary particle size of at least 1 μm and less than 5 μm and a pigment having an average secondary particle size of at least 5 μm are used in combination. The synthetic amorphous silica having an average secondary particle size of at least 5 μm is relatively large particles and serves to form porosity for ink absorption. However, if the average secondary particle size exceeds 20 μm, the smoothness of the surface of the ink-absorbing layer tends to deteriorate, and a synthetic silica having an average secondary particle size of at least 5 μm and not exceeding 20 μm, is preferred.

On the other hand, the pigment having an average secondary particle size of at least 1 μm and less than 5 μm absorbs an ink which is likely to cause bleeding with a pigment having an average secondary particle size of at least 5 μm, by its smaller pores, to improve the printing property. In this case, if a pigment having an average secondary particle size which is too small, is employed, there may be a problem in the handling efficiency during the production process, or it may shield the porosity formed by the pigment having an average secondary particle size of at least 5 μm, to deteriorate the printing property.

The compositional ratio of the pigments used in combination, is preferably within a range of from 1/1 to 1/10 in a weight ratio of the pigment having an average secondary particle size of at least 1 μm and less than 5 μm to the pigment having an average secondary particle size of at least 5 μm. If the pigment having an average secondary particle size of at least 1 μm and less than 5 μm, exceeds this ranges, the porosity formed by the synthetic amorphous silica having an average secondary particle size of 5 μm will be shielded or clogged, whereby the printing property will deteriorate. On the other hand, if the pigment having an average secondary particle size of at least 5 μm exceeds this range, the film strength tends to deteriorate, or the color development tends to deteriorate due to sinking of the ink. More preferably, the weight ratio is from 1/1 to 1/5.

In general, synthetic amorphous silica has a certain degree of particle size distribution, and the particle sizes have different values within a certain range. Not all particle sizes of synthetic amorphous silica to be used in the present invention are required to fall in the above-mentioned range, so long as the value represented by the average particle size of the synthetic amorphous silica, falls within the range. However, the narrower the particle size distribution, the better.

In a case where an ink-absorbing layer is formed mainly by inorganic fine particles, a binder is added for the purpose of improving the coating layer strength. Such a binder may, for example, be various water-soluble polymer such as gelatin, polyvinyl pyrrolidone, a water-soluble cellulose derivative, polyvinyl alcohol, a polyvinyl alcohol derivative, polyacrylamide, or polyacrylic acid as well as a polymer latex such as SBR, an ethylene-vinyl acetate copolymer, an ethylene-acrylic acid copolymer, an ethylene-acrylate copolymer, a styrene-acrylic acid copolymer, an acrylate polymer, a vinyl chloride polymer or a styrene polymer. Among these binders, polyvinyl alcohol or a polyvinyl alcohol derivative is most preferably employed.

The amount of the binder to be used together with the inorganic fine particles is usually within a range of at most 50 wt %, preferably from 1 to 30 wt %, based on the inorganic fine particles.

In the present invention, in addition to the binder, a surfactant may be incorporated to the ink-absorbing layer for the purpose of improving dot reproducibility. The surfactant to be used may be of any type such as an anion type, cation type, nonionic type or betaine type, and may be of a low molecular weight or of a high molecular weight. One or more surfactants may be incorporated in the coating fluid for the ink-absorbing layer. In a case where two or more surfactants are used in combination, it is not advisable to use a combination of an anion type surfactant and a cation type surfactant. The amount of the surfactant is preferably from 0.001 to 5 g, more preferably from 0.01 to 3 g, per 100 g of the binder constituting the ink-absorbing layer.

In the present invention, the ink-absorbing layer may be hardened by a suitable hardening agent for the purpose of improving the water resistance or dot reproducibility. Specific examples of such a hardening agent include an aldehyde compound such as formaldehyde or glutaraldehyde, a ketone compound such as diacetyl or chloropentadione, bis(2-chloroethyl urea)-2-hyroxy-4,6-dichloro-1,3,5-triazine, a reactive halogen-containing compound, divinylsulfone, a reactive olefin-containing compound, an N-methylol compound, an isocyanate, an aziridine compound, a carbodiimide compound, an epoxy compound, a halogen carboxy aldehyde such as mucochloric acid, a dioxane derivative such as dihydroxydioxane, and an inorganic hardening agent such as chromium alum, potassium alum or zirconium sulfate. These agents may be used alone or in combination as a mixture of two or more of them. The amount of the hardening agent is preferably from 0.01 to 10 g, more preferably from 0.1 to 5 g, per 100 g of the binder constituting the ink-absorbing layer.

In the present invention, when an ink-absorbing layer is to be formed, the coating amount is preferably from 3 to 40 $g/m^2$, more preferably from 5 to 30 $g/m^2$. If the coating amount of the ink-absorbing layer is larger than 40 $g/m^2$, the ink tends to sink in the case of an ink-absorbing layer employing inorganic fine particles, whereby not only the image tends to be unclear, but also the ink-absorbing layer is likely to undergo cracking during the transportation by a printer.

In the present invention, in addition to the above-mentioned inorganic pigments, various known additives such as a surfactant, a hardening agent, a coloring dye, a coloring pigment, a fixing agent for an ink dye, an ultraviolet absorber, an antioxidant, a dispersing agent for pigment, a defoaming agent, a leveling agent, a preservative, a fluorescent brightening agent, a viscosity-stabilizer and a pH-adjusting agent, may be incorporated to the ink-absorbing layer and the layer comprising fine particles of a thermoplastic organic polymer.

In the present invention, the coating method for a coating fluid for an ink-absorbing layer or for a coating fluid for the layer comprising fine particles of a thermoplastic organic polymer, is not particularly limited, and a commonly employed coating method (such as a slide lip system, a curtain system, an extrusion system, an air knife system, a roll coating system or a rod bar coating system) may be employed. However, a slide lip system or a curtain system is preferably employed, since it is thereby possible to provide the ink-absorbing layer and the layer comprising fine particles of a thermoplastic organic polymer at the same time.

In the present invention, the ink-absorbing layer may be formed to have a multilayer structure. Usually, a multi-layered layer structure is employed in which layers having various functions, such as an ink-absorbing layer, an ink-fixing layer, a water-resistant layer and an ink-permeating layer, may be arranged as the case requires. As examples of such a multilayer structure of an ink-absorbing layer, those disclosed in JP-A-57-89954, JP-A-60-224578 and JP-A-61-12388 may be mentioned.

As the support for the recording medium of the present invention, any one of conventional supports may be employed, including, for example:

(a) A non-coated paper made from a natural pulp including a chemical pulp such as LBKP or NBKP, a mechanical pulp such as GP, PGW, RMP, TMP, CTMP, CMP or CGP, or a waste paper pulp such as DIP, and a known pigment, as the main components, made by using a slurry having a binder and at least one additive such as a sizing agent, a primer, a yield-improving agent, a cation agent or a strength agent mixed therewith, and produced by various apparatus such as a Fourdrinier paper machine, a cylinder paper machine or a twin wire paper machine;

(b) A coated paper made of a non-coated paper having size press by e.g. starch or a polyvinyl alcohol or an anchor coat layer formed thereon, or an art paper, a coat paper or a cast coated paper having a coat layer provided on said non-coated paper thus obtained;

(c) A non-coated paper having smoothing treatment applied by using a calender apparatus such as a machine calender, a TG calender or a soft calender;

(d) A resin coated paper made from a non-coated paper or a coated paper, having both sides or one side coated with a high density or low density polyethylene, polypropylene or polyester by e.g. melt extrusion;

(e) A transparent synthetic resin film of e.g. polyethylene terephthalate, polypropylene, polyethylene, polyester, polycarbonate, norbornene, vinylon, polyvinyl alcohol or nylon, or a translucent or opaque synthetic resin film having e.g. a pigment or a blowing agent incorporated in such a material, to decrease the transparency;

(f) A synthetic paper made by mixing a thermoplastic resin such as polyethylene, polypropylene, an ethylene/propylene copolymer, an ethylene/vinyl acetate copolymer, polystyrene or a polyacrylate ester, with an inorganic pigment such as calcium carbonate, talc, silica or calcined clay, followed by stretching and laminating;

(g) One made of such a support having the surface treated by e.g. a corona discharge treatment, a flame treatment, a plasma treatment or an anchor layer coating treatment, to improve adhesion.

Further, a calender treatment such as machine calender, super calender, gloss calender, mat calender, abrasion calender or brush calender may be applied to such a support. The weight of the support is usually at a level of from 50 to 300 g/m$^2$.

Particularly when a water-proof support is used as the support, it is possible to obtain a water resistant product free from penetration of water from the rear side. As such a water-proof support, a transparent or non-transparent support as disclosed in the above item d), e) or f) may be employed. Further, a plate or a glass plate may, for example, be employed. Among them, a resin coated paper or a film comprising polyethylene terephthalate is most preferably employed.

The base paper constituting the resin-coated paper as a water-proof support to be preferably employed in the present invention, is not particularly limited, and a commonly employed paper can be used, but more preferably, it is preferred to employ a smooth flat base paper as is employed, for example, as a photographic support. As the pulp constituting the base paper, natural pulp, regenerated pulp and synthetic pulp may be employed alone or in combination of two or more of them. To such a base paper, additives which are commonly employed in paper making, such as a sizing agent, a paper-strength improving agent, a filler, an antistatic agent, a fluorescent brightening agent or a dye, may be incorporated.

Further, a surface sizing agent, a surface paper-strengthening agent, a fluorescent brightening agent, an antistatic agent, a dye, an anchoring agent, etc., may be coated on the surface.

The thickness of the base paper is not particularly limited, but one having surface smoothness is preferred, which has been prepared, for example, by compressing the paper during sheeting or by applying a pressure by e.g. calendering after sheeting. Its weight is preferably from 30 to 250 g/m$^2$.

The resin for the resin coated paper may be a polyolefin resin or a resin curable by electron rays. The polyolefin resin may be a homopolymer of an olefin such as low density polyethylene, high density polyethylene, polypropylene, polybutene or polypentene, or a copolymer comprising at least two olefins, such as an ethylene-propylene copolymer or a mixture thereof. Those having various densities or melt indices may be used alone or in combination as a mixture of two or more of them.

Into the resin for the resin-coated paper, it is preferred to incorporate various additives including a white pigment such as titanium oxide, zinc oxide, talc or calcium carbonate, a fatty acid amide such as stearic acid amide or arachidic acid, a metal salt of a fatty acid such as zinc stearate, calcium stearate, aluminum stearate or magnesium stearate, an antioxidant such as Irganox 1010 or Irganox 1076, a blue pigment or dye such as cobalt blue, ultramarine blue, cerulean blue or phthalocyanine blue, a magenta pigment or dye such as cobalt violet, fast violet or manganese purple, a fluorescent brightening agent and a ultraviolet absorber, in a suitable combination.

In the case of a polyolefin resin, the resin-coated paper as a support preferably employed in the present invention, can be prepared by a so-called extrusion coating method, wherein the heat-melted resin is cast on a running base paper, whereby both sides of the base paper will be coated by the resin. Further, in the case of a resin curable by electron rays, the resin may be coated on a base paper by means of a coater which is commonly employed, such as gravure coater or a blade coater, followed by irradiation with electron rays to cure the resin to cover the base paper. Further, prior to coating the base paper with the resin, it is preferred to apply activating treatment such as corona discharge treatment or flame treatment to the base paper. The side (the front surface) of the support on which the coating layer is to be formed, may have a gloss surface or a mat surface depending upon its particular purpose, and a gloss surface is employed particularly preferably. It is not necessary to cover the rear surface with the resin, but it is preferred to cover it with the resin from the viewpoint of preventing curling. The rear side is usually a dull surface, and an activating treatment such as corona discharge treatment or flame treatment may be applied to the front surface or both the front and rear surfaces, as the case requires. The thickness of the coating resin layer is not particularly limited, but usually, coating is applied on the front surface or both the front and rear surfaces in a thickness of from 5 to 50 μm.

On the support in the present invention, various back coating layers may be formed for the purpose of providing an antistatic property, transportability or an anti-curling property. To such back coating layers, various additives such as an inorganic antistatic agent, an organic antistatic agent, a hydrophilic binder, a latex, a curing agent, a pigment and a surfactant, may be incorporated in a suitable combination.

In the ink jet recording according to the present invention, a conventional ink may be suitably employed. From the viewpoint of the clearness of the image or a problem of safety of the ink itself, a water-soluble ink employing a direct dye, an acid dye, a basic dye, a reactive dye or a food colorant, is used in many cases.

On the other hand, it is possible to carry out ink jet recording satisfactorily with an ink employing a pigment as a colorant, as proposed in e.g. JP-A-57-10660, JP-A-57-10661, JP-A-4-234467, JP-A-5-156189, JP-A-5-179183, JP-A-5-202324, JP-A-5-263029, JP-A-5-331397, JP-A-6-122846 and JP-A-6-136311. The particle size of the pigment ink is preferably within a range of at least 30 nm, preferably from 50 to 300 nm, from the viewpoint of the weather resistance. By a combination of a pigment ink having such a particle size and thermoplastic resin particles of at least 1 μm, it is possible to satisfy the water resistance, weather resistance and gloss at the same time. Further, it is also possible to carry out ink jet recording satisfactorily with an oil ink employing an oil-soluble dye as the colorant, as proposed, for example, in JP-B-7-78187, JP-B-7-78188, JP-B-8-6057, JP-B-8-26259, JP-A-6-247034 and JP-A-6-306319.

In the present invention, as a method for obtaining an ink jet printed product by dissolving or melting the fine particles of a thermoplastic organic polymer to form a film by heating after ink jet recording of the ink jet recording medium, the medium may be heated at a temperature of at least the minimum-film-forming temperature of the fine particles of a thermoplastic organic polymer, and the heating means is not particularly limited. Specifically, a method may be mentioned, such as blowing a hot air directly to the layer of fine particles, pressing an iron against the layer of fine particles, passing the medium between heat rolls of e.g. a laminator which is commonly used for post treatment of a large size printer output image, or using a ferro type dryer wherein the layer of fine particles is pressed against a heating mirror surface drum which is used for e.g. drying a photograph. Among such methods, it is preferred to employ a laminator system wherein the medium is passed through heated rolls to carry out the dissolution or melting for fusion, since a large size medium can be heat-treated uniformly. It is particularly preferred to treat the medium by means of an apparatus for preparing an ink jet printed product of the present invention, which will be described below.

With respect to the heating temperature after printing, the layer comprising fine particles of a thermoplastic organic polymer is heated at a temperature of from 80 to 200° C., preferably from 100 to 140° C., whereby an image which has a high gloss and is excellent in water resistance and scratch resistance, can be formed.

In the present invention, as an apparatus for preparing an ink jet printed product whereby the layer of fine particles of a thermoplastic organic polymer is dissolved or melted to form a film by heating the ink jet recording medium, a step of heating the layer of fine particles of a thermoplastic organic polymer to a plastic state, is required. The heating means for the step is not particularly limited. In the present invention, the layer comprising fine particles of a thermoplastic organic polymer may be heated by direct contact, but it is preferred to employ a means of heating the layer without contact. Such heating means may be classified into a radiation conduction system, a convection heat transfer system and a heat conduction system by the system for heat conduction.

The heating means employing the radiation conduction system as one of the heat conduction systems to be employed in the present invention, utilizes a radiation heat and may, for example, be one employing an infrared lamp, one employing a xenon flash, or one employing a ceramic heater emitting far infrared rays. Any means employing a radiation heat, can be used, and the heating means is not limited by the type of the radiation heat source.

The heating means employing a convection heat transfer system as one of the heat conduction systems to be employed in the present invention, is one wherein the heat is conducted to the layer of fine particles of a thermoplastic organic polymer by convection, and it may, for example, be a method of heating in a box employing a sheet heater or a ribbon heater or a method for heating wherein a hot air is blown to the layer of fine particles of a thermoplastic organic polymer from a slit of an air nozzle.

The heating means employing a heat conduction system as one of the systems for heat conduction to be used in the present invention, is one wherein the heat is conducted to the layer of fine particles of a thermoplastic organic polymer by heat conduction by contact, and it may, for example, be a method for heating wherein a heat roller or a heated plate as a heat conductor, is contacted to the rear side of the support. In the method for heating by a heat roller, it is common to heat the roller by a build-in heater or to contact the layer to a heat roller which is heated by means of an electron magnetic induction heating. In the method for heating by a heated plate, it is common to contact the layer to a panel heater or a heat plate having a heater build-in, or by contacting the layer to a heat conductor having a heater connected to the rear side.

As described above, the heat conduction system to be used in the present invention is one which conducts a heat to the layer comprising fine particles of a thermoplastic organic polymer and is intended to heat the fine particles of a thermoplastic organic polymer in the layer to bring them in a plastic state, and the means is not particularly limited. Further, a plurality of such systems may be used in combination, whereby heating can be carried out efficiently, such being more preferred.

In the present invention, an impressing step of passing the recording medium between a pair of press rolls while the layer comprising fine particles of a thermoplastic organic polymer is still in a plastic state after the heating step, to transfer the shape of the roll surface to the layer comprising fine particles of a thermoplastic organic polymer. Heretofore, a method for preparing an ink jet recording image of a type wherein a layer containing fine particles of a thermoplastic organic polymer is formed, and the layer is melted for transparency or for gloss by heating, has been proposed, but in such a method, heat fusion was simultaneously carried out between the heated rolls in most cases, whereby to facilitate peeling between the roll and the layer comprising fine particles of a thermoplastic organic polymer, it was necessary to insert a film or the like. Accordingly, a step of peeling the film was required after the layer comprising fine particles of a thermoplastic organic polymer was cooled and fixed. The present inventors have found that peeling can easily be carried out even by directly contacting the layer comprising fine particles of a thermoplastic organic polymer in a plastic state to a roll having a surface temperature which is lower than the heating temperature of the layer of fine particles of a thermoplastic organic polymer, to transfer the shape of the roll surface to the layer, and the present invention has been accomplished on the basis of this discovery.

Namely, in the present invention, the impressing step is a step of passing the recording medium between a pair of press rolls while the layer comprising fine particles of a thermoplastic organic polymer is still in a plastic state. Preferably, it is a step for fixing while transferring the shape of the roll surface to the layer comprising fine particles of a thermoplastic organic polymer by adjusting the surface temperature of the roll which contacts the layer comprising fine particles of a thermoplastic organic polymer to a level of lower than the heating temperature of the layer of fine particles of a thermoplastic organic polymer and making the roll surface to be a mirror-finished surface, a roughened or mat surface or a surface having a patterned engraving.

The material of the roll surface may be a material which is commonly used, such as rubber, a synthetic resin or metal. However, one having surface treated with a resin excellent in a release property such as a fluorine resin or a silicone resin, or a polished metal surface or a surface mirror-finished by e.g. chromium plating, is preferably employed.

Further, the surface shape of the roll may be a mirror-finished surface, a roughened surface (mat surface) or a patterned roll surface having a pattern so-called a silk pattern or a fine grain surface in e.g. a photographic paper industry engraved. The silk pattern usually comprises a continuous conical, rectangular or rhombic shape, and the fine grain surface usually has a pattern of a continuous gently sloping mountain range, and the height of mountains from the valleys is preferably at least 10 $\mu$m, as the pattern becomes clear as the height is larger.

An example of a surface treating method for a patterned roll to be used in the present invention will be briefly described. On the surface of a roll made of e.g. iron, grinder polishing is applied, and further a buff polishing is carried out, whereupon chromium plating is applied thereon. Buff polishing is again applied, and on the surface, a small size roll having e.g. a silk pattern formed on the surface, which is so-called a mother, is pressed and rotated to impress a pattern corresponding to a negative form of the silk pattern. Thereafter, chromium plating is further applied, and if necessary, sand blasting is applied thereon by means of a grinding sand of a certain predetermined size for finishing.

The temperature of the roll surface is maintained at a level lower than the heating temperature of the layer of fine particles of a thermoplastic organic polymer. Accordingly, it is preferred to provide a means of controlling the temperature.

Now, the present invention will be described in further detail with reference to Examples. However, it should be understood that the present invention is by no means restricted to such specific Examples.

EXAMPLE 1

On a resin coated paper support as identified below, a coating fluid for an ink-absorbing layer and a layer comprising fine particles of a thermoplastic organic resin as identified below were sequentially coated. The coating fluid for an ink-absorbing layer was coated by means of a bar coater so that the coating amount of the solid content of the ink-absorbing layer would be 20 g/m$^2$ and then dried by controlling the temperature and humidity of the drying zone so that the surface wet-bulb temperature would be at most 70° C. On the upper layer, a layer comprising fine particles of a thermoplastic organic resin was coated by an air knife system so that the coating amount of the solid content in the layer comprising fine particles of a thermoplastic organic resin would be 10 g/m$^2$, followed by controlling the temperature and humidity in the drying zone so that the surface wet-bulb temperature would be at most 60° C. to obtain an ink jet recording medium of Example 1.

Resin-coated Paper Support

A resin-coated paper obtained by coating 25 g/m$^2$ of a resin composition comprising a low density polyethylene (70 parts), a high density polyethylene (20 parts) and titanium oxide (10 parts) on the front side of a base paper of 120 g/m$^2$ containing a pulp blend of hardwood (Laubholz) bleached kraft pulp (LBKP, 50 parts) and hardwood (Laubholz) bleached sulfite pulp (LBSP, 50 parts), and coating 25 g/m$^2$ of a resin composition comprising a high density polyethylene (50 parts) and a low density polyethylene (50 parts) on the rear side.

Ink-absorbing Layer

| | |
|---|---|
| Fine particles of silica (Finesil X60, 20% aqueous dispersion) (particle size: 6 $\mu$m, manufactured by Tokuyama Corp.) | 50 parts |
| Binder (R-1130, 10% aqueous solution) (silanol-modified PVA, manufactured by Kuraray Co., Ltd.) | 8 parts |

Laver Comprising Fine Particles of a Thermoplastic Organic Polymer

| | |
|---|---|
| Fine particles of a thermoplastic organic polymer (Chemipearl V-200, manufactured by Mitsui Chemicals, Inc.) (ethylene vinyl acetate copolymer, MFT: 90° C., particle size: 6 $\mu$m, 10% aqueous dispersion) | 100 parts |
| Binder (PVA117 (10% aqueous solution), manufactured by Kuraray Co., Ltd.) | 14 parts |

Printing of Ink Jet Recording Image

With respect to the ink jet recording medium of Example 1 thus obtained, a test image was printed by a Novajet PRO ink jet large size printer (manufactured by Encad Inc.) by means of a pigment ink (GO ink) and a water-soluble dye ink (GS ink) to prepare Example 1 (GO printed image) and Example 1 (GS printed image). The average particle size of the pigment in the above pigment ink was 100 nm (as measured by means of a laser diffraction/scattering type particle size distribution measuring apparatus LA-910, manufactured by Horiba, Ltd.)

EXAMPLE 2

An ink jet recording medium of Example 2 was prepared in the same manner as in Example 1 except that the fine particles of a thermoplastic organic polymer used in Example 1 were changed to Chemipearl V-300 (ethylene-vinyl acetate copolymer, MFT: 90° C., particle size: 5 μm, 10% aqueous dispersion, manufactured by Mitsui Chemicals, Inc.). Further, printing of an ink jet recording image was carried out in the same manner as in Example 1 to obtain Example 2 (GO printed image) and Example 2 (GS printed image).

EXAMPLE 3

An ink jet recording medium of Example 3 was prepared in the same manner as in Example 1 except that the fine particles of a thermoplastic organic polymer used in Example 1 were changed to Chemipearl M-200 (polyethylene emulsion, MFT: 105° C., particle size: 6 μm, 10% aqueous dispersion, manufactured by Mitsui Chemicals, Inc.). Further, an ink jet recording image was printed in the same manner as in Example 1 to obtain Example 3 (GO printed image) and Example 3 (GS printed image).

EXAMPLE 4

An ink jet recording medium of Example 4 was prepared in the same manner as in Example 1 except that the fine particles of a thermoplastic organic polymer used in Example 1 were changed to an ethylene-acrylate copolymer (MFT: 135° C., particle size: 1.2 μm, 10% aqueous dispersion). Further, an ink jet recording image was printed in the same manner as in Example 1 to obtain Example 4 (GO printed image) and Example 4 (GS printed image).

EXAMPLE 5

An ink jet recording medium of Example 5 was prepared in the same manner as in Example 1 except that the fine particles of a thermoplastic organic polymer used in Example 1 were changed to an ethylene-vinyl acetate copolymer (MFT: 90° C., particle size: 18 μm, 10% aqueous dispersion). Further, an ink jet recording image was printed in the same manner as in Example 1 to obtain Example 5 (GO printed image) and Example 5 (GS printed image).

EXAMPLE 6

An ink jet recording medium of Example 6 was prepared in the same manner as in Example 1 except that the fine particles of a thermoplastic organic polymer used in Example 1 were changed to a vinyl chloride-vinyl acetate copolymer (MFT: 130° C., particle size: 1.2 μm, 10% aqueous dispersion). Further, an ink jet recording image was printed in the same manner as in Example 1 to obtain Example 6 (GO printed image) and Example 6 (GS printed image).

COMPARATIVE EXAMPLE 1

An ink jet recording medium of Comparative Example 1 was prepared in the same manner as in Example 1 except that the fine particles of a thermoplastic organic polymer used in Example 1 were changed to SBR latex (Nipol LX382, manufactured by Nippon Zeon Co., Ltd., particle size: 0.12 μm, 10% diluted liquid). Further, an ink jet recording image was printed in the same manner as in Example 1 to obtain Comparative Example 1 (GO printed image) and Comparative Example 1 (GS printed image).

COMPARATIVE EXAMPLE 2

An ink jet recording medium of Comparative Example 2 was prepared in the same manner as in Example 1 except that the fine particles of a thermoplastic organic polymer used in Example 1 were changed to an ethylene-vinyl acetate copolymer (particle size: 0.8 μm). Further, an ink jet recording image was printed in the same manner as in Example 1 to obtain Comparative Example 2 (GO printed image) and Comparative Example 2 (GS printed image).

COMPARATIVE EXAMPLE 3

An ink jet recording medium of Comparative Example 3 was prepared in the same manner as in Example 1 except that the fine particles of a thermoplastic organic polymer used in Example 1 were changed to an ethylene-vinyl acetate copolymer (particle size: 25 μm). Further, an ink jet recording image was printed in the same manner as in Example 1 to obtain Comparative Example 3 (GO printed image) and Comparative Example 3 (GS printed image).

EXAMPLE 7

An ink jet recording medium of Example 7 was prepared in the same manner as in Example 1 except that the coating fluid composition for the layer comprising fine particles of a thermoplastic organic polymer was changed as shown below. Further, an ink jet recording image was printed in the same manner as in Example 1 to obtain Example 7 (GO printed image) and Example 7 (GS printed image).

Layer Comprising Fine Particles of a Thermoplastic Organic Polymer

| | |
|---|---|
| Fine particles of a thermoplastic organic polymer (Chemipearl V-200, manufactured by Mitsui Chemicals, Inc.) (ethylene vinyl acetate copolymer, MFT: 90° C., particle size: 6 μm, 10% aqueous dispersion) | 100 parts |
| Colloidal silica (Snowtex XL, manufactured by Nissan Chemical Industries, Ltd) (particle size: 0.04 to 0.05 μm, 10% diluted liquid) | 8 parts |
| Binder (PVA117 (10% aqueous solution), manufactured by Kuraray Co., Ltd.)) | 8 parts |

EXAMPLE 8

An ink jet recording medium of Example 8 was prepared in the same manner as in Example 7 (accordingly Example 1) except that the colloidal silica of Example 7 was changed to Snowtex OZL (particle size: 0.07 to 0.10 μm, 10% diluted liquid). Further, an ink jet recording image was printed in the same manner as in Example 1 to obtain Example 8 (GO printed image) and Example 8 (GS printed image).

EXAMPLE 9

An ink jet recording medium of Example 9 was prepared in the same manner as in Example 7 except that the fine particles of a thermoplastic organic polymer of Example 7 were changed to an ethylene-acrylic acid copolymer (MFT: 135° C., particle size: 1.2 μm, 10% aqueous dispersion). Further, an ink jet recording image was printed in the same manner as in Example 1 to obtain Example 9 (GO printed image) and Example 9 (GS printed image).

EXAMPLE 10

An ink jet recording medium of Example 10 was prepared in the same manner as in Example 7 except that the fine particles of a thermoplastic organic polymer of Example 7 were changed to an ethylene-acrylic acid copolymer (MFT: 90° C., particle size: 18 μm, 10% aqueous dispersion). Further, an ink jet recording image was printed in the same manner as in Example 1 to obtain Example 10 (GO printed image) and Example 10 (GS printed image).

COMPARATIVE EXAMPLE 4

An ink jet recording medium of Comparative Example 4 was prepared in the same manner as in Example 7 except that the fine particles of a thermoplastic organic polymer of Example 7 were changed to SBR latex (Nipol LX382, manufactured by Nippon Zeon Co., Ltd., particle size: 0.12 μm, 10% diluted liquid). Further, an ink jet recording image was printed in the same manner as in Example 1 to obtain Comparative Example 4 (GO printed image) and Comparative Example 4 (GS printed image).

COMPARATIVE EXAMPLE 5

An ink jet recording medium of Comparative Example 5 was prepared in the same manner as in Example 7 except that the fine particles of a thermoplastic organic polymer of Example 7 were changed to an ethylene-vinyl acetate copolymer (particle size: 0.8 μm, 10% diluted liquid). Further, an ink jet recording image was printed in the same manner as in Example 1 to obtain Comparative Example 5 (GO printed image) and Comparative Example 5 (GS printed image).

COMPARATIVE EXAMPLE 6

An ink jet recording medium of Comparative Example 6 was prepared in the same manner as in Example 7 except that the fine particles of a thermoplastic organic polymer of Example 7 were changed to an ethylene-vinyl acetate copolymer (particle size: 25 μm, 10% diluted liquid). Further, an ink jet recording image was printed in the same manner as in Example 1 to obtain Comparative Example 6 (GO printed image) and Comparative Example 6 (GS printed image).

EXAMPLE 11

An ink jet recording medium of Example 11 was prepared in the same manner as in Example 1 except that the composition of the coating fluid for an ink-absorbing layer was changed as follows. Further, an ink jet recording image was printed in the same manner as in Example 1 to obtain Example 11 (GO printed image) and Example 11 (GS printed image).

Ink-absorbing Layer

| | |
|---|---|
| Fine particles of silica (Mizukasil P-78D, 20% aqueous dispersion) (particle size: 8 μm, manufactured by Mizusawa Industrial Chemicals, Ltd.) | 70 parts |
| Fine particles of silica (Finesil X-30) 20% aqueous dispersion) (particle size: 3 μm, manufactured by Tokuyama Corp.) | 70 parts |
| Binder (PVA235, manufactured by Kuraray Co., Ltd.) | 20 parts |
| Cation fixing agent (Sumirez Resin 1001, manufactured by Sumitomo Chemical Co., Ltd.) | 20 parts |

EXAMPLE 12

On a resin-coated paper support as identified below, a coating fluid for an ink-absorbing layer and a layer comprising fine particles of a thermoplastic organic polymer as identified below, were coated simultaneously by a multilayer extrusion method by adjusting the amounts of the respective coating fluids so that the coating amount of the solid content of the ink-absorbing layer would be 17 g/m$^2$ and the coating amount of the solid content of the layer comprising fine particles of a thermoplastic organic polymer would be 7 g/m$^2$, followed immediately by cooling and setting for 10 seconds. Then, the coated support was passed through a drying zone wherein the temperature became gradually high, and the temperature and humidity in the drying zone were controlled so that the surface wet-bulb temperature would be at most 30° C., to obtain an ink jet recording medium of Example 12.

Resin-coated Paper Support

A resin-coated paper prepared by coating 25 g/m$^2$ of a resin composition comprising a low density polyethylene (70 parts), a high density polyethylene (20 parts) and titanium oxide (10 parts) on the front side of a base paper of 120 g/m$^2$ containing a pulp blend of LBKP (50 parts) and LBSP (50 parts), and coating 25 g/m$^2$ of a resin composition comprising a high density polyethylene (50 parts) and a low density polyethylene (50 parts) on the rear side.

Ink-absorbing Layer

| | |
|---|---|
| Fine particles of silica (Finesil X60, manufactured by Tokuyama Corp.) | 69 parts |
| Binder (PVA235, manufactured by Kuraray Co., Ltd.) | 14 parts |
| Cation fixing agent (Sumirez Resin 1001, manufactured by Sumitomo Chemical Co., Ltd.) | 17 parts |

Layer Comprising Fine Particles of a Thermoplastic Organic Polymer

| | |
|---|---|
| Fine particles of a thermoplastic organic polymer (ethylene vinyl acetate copolymer, MFT: 90° C., particle size: 4 μm) | 86 parts |
| Release agent (calcium stearate emulsified product) | 0.1 part |
| Binder (PVA235, manufactured by Kuraray Co., Ltd.) | 14 parts |

Printing of An Ink Jet Recording Image

With respect to an ink jet recording medium of Example 12 thus obtained, a test image was printed by a Novajet PRO (manufactured by Encad Inc.) ink jet large size printer by means of a pigment ink (GO ink) and a water-soluble dye ink (GS ink) to obtain Example 12 (GO printed image) and Example 12 (GS printed image). The average particle size of the pigment in the pigment ink was 100 nm (as measured by a laser diffraction/scattering system particle size distribution measuring apparatus LA-910, manufactured by Horiba, Ltd.).

EXAMPLE 13

As a composition for an ink-absorbing layer, a coating fluid having a solid content of about 7% comprising 7 parts (solid content) of an alumina sol (Cataloid AS-3, manufactured by Catalysis and Chemicals Ind. Co., Ltd.), 1 part (solid content) of polyvinyl alcohol (Shin-etsu Poval MA-26, manufactured by Shin-etsu Chemical Co., Ltd.) and water, was prepared and coated on a paper support as identified below by a bar coater so that the dried coating amount would be 15 g/m$^2$, followed by drying to form a first layer of an ink-absorbing layer. Then, a coating fluid having a solid content of about 30% comprising 25 parts (solid content) of a polyolefin type elastomer (Chemipearl A100, manufactured by Mitsui chemicals, Inc., MFT: 85° C., particle size: 4 $\mu$m) being an aqueous dispersion of fine particles of a thermoplastic organic polymer and 3.0 parts of polyvinyl pyrrolidone, was coated thereon by a curtain coater so that a dried coating amount would be 5 g/m$^2$, followed by drying to obtain an ink jet recording medium of Example 13.

Preparation of Paper Support

A pulp mixture comprising 85 wt % of LBKP and 15 wt % of softwood (Nadelholz) bleached sulfite pulp (NBSP), was beaten to a beating degree of 320 ml, csf. Then, to 100 parts by weight of the pulp, 3 parts by weight of cationic starch, 0.2 part by weight of an anionic polyacrylamide, 0.3 part by weight (as the ketene diner content) of an alkylketene dimer emulsified product and 0.4 part by weight of a polyamide epichlorohydrin resin, were added to prepare a stock slurry. Then, the stock slurry was subjected to Fourdrinier paper machine to form a paper sheet, which was subjected to three step wet pressing at a wet part, followed by treatment by a smoothing roll and then subjected to two step bulk density pressing at the subsequent drying part, followed by drying. Then, during the drying, a solution of a carboxy-modified polyvinyl alcohol was size-pressed so that the solid content deposited amount would be 5.0 g/m$^2$, followed by drying so that the water content of the base paper finally obtained would be 8 wt % as an absolutely dried water content, followed by machine calender treatment to obtain a support for an ink jet recording medium having a weight of 150 g/m$^2$ Printing of An Ink Jet Recording Image On the ink jet recording medium of Example 13 obtained as described above, solid printing of four elementary colors and recording of a highly fine photographic image were carried out by means of an ink jet printer (PM-750C) manufactured by Seiko Epson Corp. to obtain Example 13 (PM printed image).

EXAMPLE 14

On a support as identified below, a coating fluid having a solid content of about 30% comprising 25 parts (solid content) of a polyolefin type latex (Chemipearl M200, manufactured by Mitsui Chemicals, Inc., MFT: 105° C., particle size: 6 $\mu$m) being an aqueous dispersion of fine particles of a thermoplastic organic polymer and 3.0 parts of polyvinyl pyrrolidone, was coated by a curtain 2 coater so that a dried coating amount would be 25 g/m$^2$; followed by drying to obtain an ink jet recording medium of Example 14.

Preparation of Paper Support

To a pulp mixture comprising 85 wt % of LBKP beaten by a double disk refiner to 320 ml, csf and 15 wt % of a softwood (Nadelholz) bleached kraft pulp (NBKP) beaten by a double disk refiner to 430 ml, csf, 1.0 wt % of cationic starch, 0.1 wt % of an alkylketene dimer sizing agent and 12 wt % of a calcium carbonate heavy filler, were added to prepare a stock slurry. The stock slurry was subjected to a Forwardlinear paper machine to form a paper sheet, and during the drying, a solution containing 5 wt % of oxidized starch was size-pressed, followed by drying so that the water content of the base paper finally obtainable would be 6 wt % as an absolutely dried water content and then by a machine calender treatment to obtain a support for an ink jet recording medium having a weight of 80 g/m$^2$.

Printing of An Ink Jet Recording Image

On the ink jet recording medium of Example 14 obtained as described above, solid printing of four elementary colors and recording of a highly fine photographic image were carried out by means of an oil color ink jet plotter (IP-4000) manufactured by Seiko Instruments Inc., to obtain Example 14 (IP printed image).

EXAMPLE 15

On the same support as used in Example 14, an ink-absorbing layer having the following formulation was coated in an amount of 10 g/m$^2$. Then, the same coating fluid as used in Example 14 was coated thereon in an amount of 8 g/m$^2$, followed by drying to obtain an ink jet recording medium of Example 15.

Formulation of the Ink-absorbing Layer

| | |
|---|---|
| Synthetic amorphous silica (oil absorption: 236 ml/100 g, average particle size: 3.5 $\mu$m) | 100 parts |
| Binder (PVA117, 10% aqueous solution, manufactured by Kuraray Co., Ltd.) | 200 parts |
| Cationic fixing agent (Sumirez Resin 1001, 30% aqueous solution, manufactured by Sumitomo Chemical Co., Ltd.) | 50 parts |
| Water | 450 parts |

Printing of An Ink Jet Recording Image

On the ink jet recording medium of Example 15 obtained as described above, solid printing of four elementary colors and recording of a highly fine photographic image were carried out by means of an ink jet printer (PM-750C), manufactured by Seiko Epson Corp., to obtain Example 15 (PM printed image).

EXAMPLE 16

Using a white polyethylene terephthalate film as a support, a coating fluid containing fine particles of a thermoplastic organic polymer having the following formulation, was coated twice by an air knife coater so that the total coated amount would be 45 g/m$^2$, to obtain an ink jet recording medium of Example 16.

Layer Comprising Fine Particles of a Thermoplastic Organic Polymer

| | |
|---|---|
| Fine particles of a thermoplastic organic polymer (Chemipearl M200, manufactured by Mitsui Chemicals, Inc.) (polyolefin type latex, MFT: 105° C., particle size: 6 $\mu$m) | 50 parts |

-continued

| | |
|---|---|
| Fine particles of a thermoplastic organic polymer (Chemipearl S200, manufactured by Mitsui Chemicals, Inc.) (polyolefin type ionomer, MFT: 85° C., particle size: 0.5 μm) | 32 parts |
| Binder (PVA117, manufactured by Kuraray Co., Ltd.) | 18 parts |

Printing of An Ink Jet Recording Image

On the ink jet recording medium of Example 16 obtained as described above, solid printing of four elementary colors and recording of a high fine photographic image were carried out by means of an ink jet printer (PM-750C) manufactured by Seiko Epson Corp., to obtain Example 16 (PM printed image).

Preparation of An Ink Jet Printed Product

Then, the layer comprising fine particles of a thermoplastic organic polymer of the recording medium having such an ink jet recording image printed, thus obtained, was subjected to heating and melting treatment to prepare an ink jet printed product. The treating conditions were as follows.

Printed products of Examples 1 to 16 and Printed Products of Comparative Examples 1 to 6

Using a large size laminator (M-36, manufactured by Fuji Photo Film Co,. Ltd.), a printed recording medium was passed through a pair of heat rollers (temperature: 120° C., provided that the temperature was 140° C. for the recording media of Examples 4, 6 and 9) while sandwiching the medium by polyester films, to dissolve or melt for fusion treatment. The polyester films were used to prevent the printed recording medium from adhering to the heat rollers. Those printed with GO ink and GS ink were, respectively, treated in the same manner. With respect to samples subjected to fusion treatment by dissolving or melting, the following quality tests were carried out, whereby the results as shown in Table 1 were obtained.

Printing Irregularities:

Each of colors Y, M, C, R, G, B and K (black) was output at a set density of 100% in a size of 3 cm×5 cm, and the image portion was visually inspected to determine the presence or absence of irregularities observed at the printed portion of each color. This is one of indices showing the resolution and clearness of the image. The evaluation standards were as follows.

◎: Excellent without any problem

○: Good

Δ: Acceptable for use

X: Inferior

Bleeding:

A single color or double colors were continuously recorded, whereupon whether or not the adjacent printed portions bleeded mutually or one-sidedly, was visually evaluated. This is one of indices showing the resolution and clearness of the image. The evaluation standards were as follows.

◎: Excellent without any problem

○: Good

Δ: Acceptable for use

X: Inferior

Gloss:

The 60° gloss of the surface of an ink jet printed product subjected to heating and fusion treatment, was measured, and the average value was calculated. The higher the numerical value, the higher the gloss, such being preferred.

Water Resistance:

An ink jet printed product subjected to heating and fusing treatment, was immersed in water at room temperature for 24 hours, whereupon bleeding of the image and a decrease in the density due to dissolution into water, were visually evaluated. The evaluation standards were as follows.

○: No change of the image was observed without bleeding or a decrease in the density.

Δ: The image was maintained although the density was slightly lowered.

X: The ink dissolved, and the image was destroyed.

Light Resistance:

An ink jet printed product subjected to heating and fusing treatment, was left to stand outdoors, and the change in the image density after one month, was visually evaluated. The evaluation standards were as follows.

○: No change in the image was observed as compared immediately after printing.

Δ: Slight fading of the image was observed.

X: Remarkable fading of the image was observed.

Scratch Resistance:

An ink jet printed product subjected to heating and fusing treatment, was rubbed with a cotton cloth, whereby the degree of scratching of the surface was visually evaluated. The evaluation standards were as follows.

◎: Excellent with almost no scratching observed.

○: Slight scratching was observed, but it was practically no problematic level.

Δ: Scratching was observed, but it was a practically acceptable level.

X: Scratching was observed over the entire surface, and the image was destroyed to a practical unacceptable level.

TABLE 1

| Printed products | Printing irregularities | Bleeding | Gloss | Water resistance | Light resistance | Scratch resistance |
|---|---|---|---|---|---|---|
| Ex. 1 (GO printed image) | ◎ | ◎ | 85 | ○ | ○ | Δ |
| Ex. 1 (GS printed image) | ◎ | ◎ | 85 | ○ | Δ | Δ |
| Ex. 2 (GO printed image) | ◎ | ◎ | 85 | ○ | ○ | Δ |
| Ex. 2 (GS printed image) | ◎ | ◎ | 85 | ○ | Δ | Δ |
| Ex. 3 (GO printed image) | ◎ | ◎ | 88 | ○ | ○ | Δ |
| Ex. 3 (GS printed image) | ◎ | ◎ | 88 | ○ | Δ | Δ |
| Ex. 4 (GO printed image) | ○ | ○ | 85 | ○ | ○ | Δ |
| Ex. 4 (GS printed image) | ○ | ○ | 85 | ○ | Δ | Δ |
| Ex. 5 (GO printed image) | ○ | ○ | 82 | ○ | ○ | Δ |

TABLE 1-continued

| Printed products | Printing irregularities | Bleeding | Gloss | Water resistance | Light resistance | Scratch resistance |
|---|---|---|---|---|---|---|
| Ex. 5 (GS printed image) | ○ | ○ | 82 | ○ | Δ | Δ |
| Ex. 6 (GO printed image) | ○ | ○ | 80 | ○ | ○ | Δ |
| Ex. 6 (GS printed image) | ○ | ○ | 80 | ○ | Δ | Δ |
| Ex. 7 (GO printed image) | ◎ | ◎ | 82 | ○ | ○ | ○ |
| Ex. 7 (GS printed image) | ◎ | ◎ | 82 | ○ | Δ | ○ |
| Ex. 8 (GO printed image) | ◎ | ◎ | 78 | ○ | ○ | ○ |
| Ex. 8 (GS printed image) | ◎ | ◎ | 78 | ○ | Δ | ○ |
| Ex. 9 (GO printed image) | ○ | ○ | 80 | ○ | ○ | ○ |
| Ex. 9 (GS printed image) | ○ | ○ | 80 | ○ | Δ | ○ |
| Ex. 10 (GO printed image) | ○ | ○ | 80 | ○ | ○ | ○ |
| Ex. 10 (GS printed image) | ○ | ○ | 80 | ○ | Δ | ○ |
| Ex. 11 (GO printed image) | ◎ | ◎ | 80 | ○ | ○ | Δ |
| Ex. 11 (GS printed image) | ◎ | ◎ | 80 | ○ | Δ | Δ |
| Ex. 12 (GO printed image) | ○ | ◎ | 88 | ○ | ○ | Δ |
| Ex. 12 (GS printed image) | ○ | ◎ | 88 | ○ | Δ | Δ |
| Ex. 13 (PM printed image) | ◎ | ◎ | 90 | ○ | Δ | Δ |
| Ex. 14 (IP printed image) | ◎ | Δ | 88 | ○ | Δ | Δ |
| Ex. 15 (PM printed image) | ◎ | ◎ | 88 | ○ | Δ | Δ |
| Ex. 16 (PM printed image) | ○ | Δ | 88 | ○ | Δ | Δ |
| Comp. Ex. 1 (GO printed image) | x | x | 80 | ○ | ○ | Δ |
| Comp. Ex. 1 (GS printed image) | x | x | 80 | ○ | Δ | Δ |
| Comp. Ex. 2 (GO printed image) | Δ | x | 78 | ○ | ○ | Δ |
| Comp. Ex. 2 (GS printed image) | Δ | x | 78 | ○ | Δ | Δ |
| Comp. Ex. 3 (GO printed image) | ○ | Δ | 75 | x | ○ | Δ |
| Comp. Ex. 3 (GS printed image) | ○ | Δ | 75 | x | Δ | Δ |
| Comp. Ex. 4 (GO printed image) | x | x | 78 | x | ○ | Δ |
| Comp. Ex. 4 (GS printed image) | x | x | 78 | x | Δ | Δ |
| Comp. Ex. 5 (GO printed image) | Δ | x | 75 | Δ | ○ | ○ |
| Comp. Ex. 5 (GS printed image) | Δ | x | 75 | Δ | Δ | ○ |
| Comp. Ex. 6 (GO printed image) | Δ | Δ | 71 | x | ○ | Δ |
| Comp. Ex. 6 (GS printed image) | Δ | Δ | 71 | x | Δ | Δ |

As is evident from the above results, with the ink jet recording media of the present invention, good results were obtained with respect to the respective evaluation items. Further, those printed with a pigment ink (GO printed images) were superior in the light resistance. Further, the products of Examples 7 to 10 wherein colloidal silica was added to the layer comprising fine particles of a thermoplastic organic polymer, were superior in the scratch resistance. Further, the products of Examples 1 to 13 and 15 wherein an ink-absorbing layer was present between the support and the layer comprising fine particles of a thermoplastic organic polymer, were superior in prevention of bleeding. Further, the product of Example 12 wherein a release agent was added to the layer comprising fine particles of a thermoplastic organic polymer was excellent in the gloss.

Preparation of An Ink Jet Printed Product by the Apparatus for Preparing a Printed Product of the Present Invention Ink Jet Printed Product A-1

Using an apparatus of FIG. 1, employing Example 12 (GO printed image) prepared as described above, a printed product having a gloss surface was prepared at a transport speed of 400 mm/min, with the upper heater 21 switched on, with the lower heating panel 22 set at a temperature of 100° C. with the pressures of the patterned roller 41 and the press roller 42 set to be 50 g/mm, said patterned roller being a metal roll with a mirror-finished surface (surface temperature: 85° C.).

Ink Jet Printed Product A-2

Figure 2:
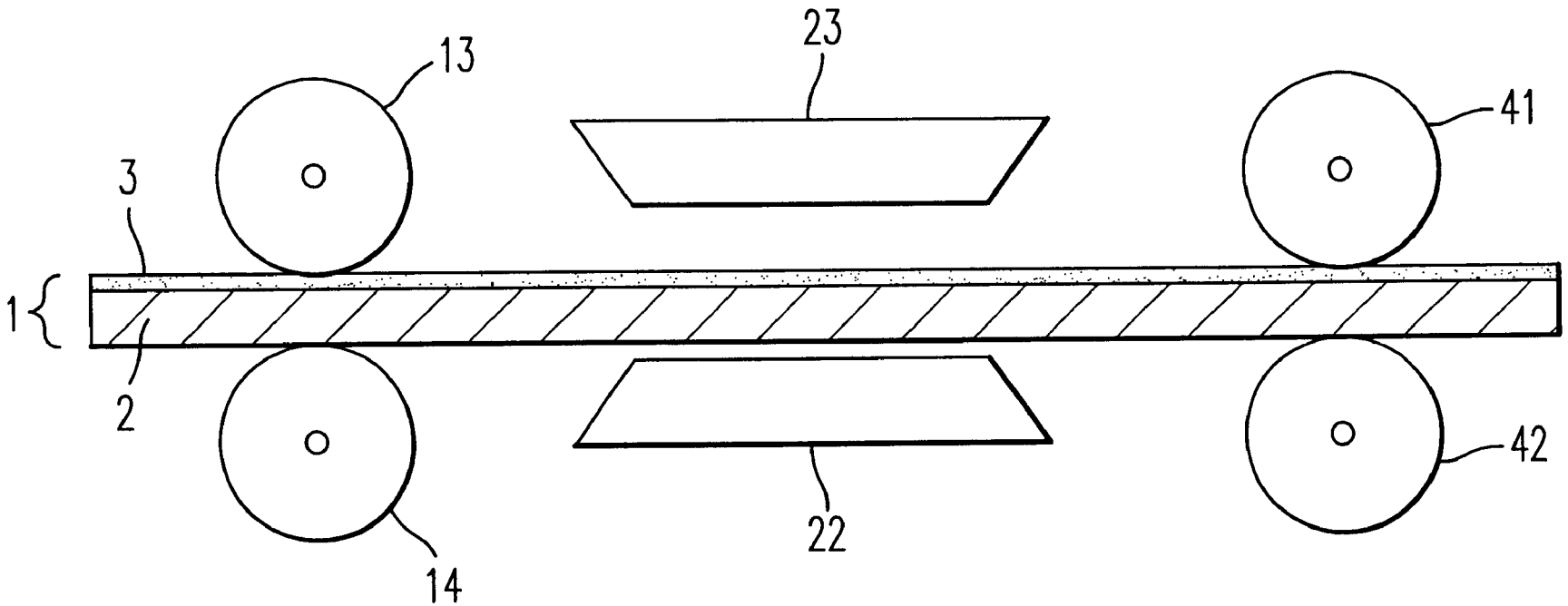
FIG. 2 is a schematic view illustrating an embodiment of the apparatus for preparing an ink jet printed product of the present invention (combined use of a heat conduction system, heat rolls and heating panels).

Using an apparatus of FIG. 2, employing Example 12 (GS printed image) prepared as described above, a mat surface printed product was prepared at a transport speed of 300 mm/min, with the temperatures of the transporting and heating rollers 13 and 14 set to be 90° C., with the temperatures of the upper heating panel 23 and the lower heating panel 22 set to be 120° C., with the pressures of the patterned roller 41 and the press roller 42 set to be 50 g/mm, said patterned roller 41 being a metal roll having a mat surface (surface temperature: 60° C.).

Ink Jet Printed Product A-3

Figure 3:
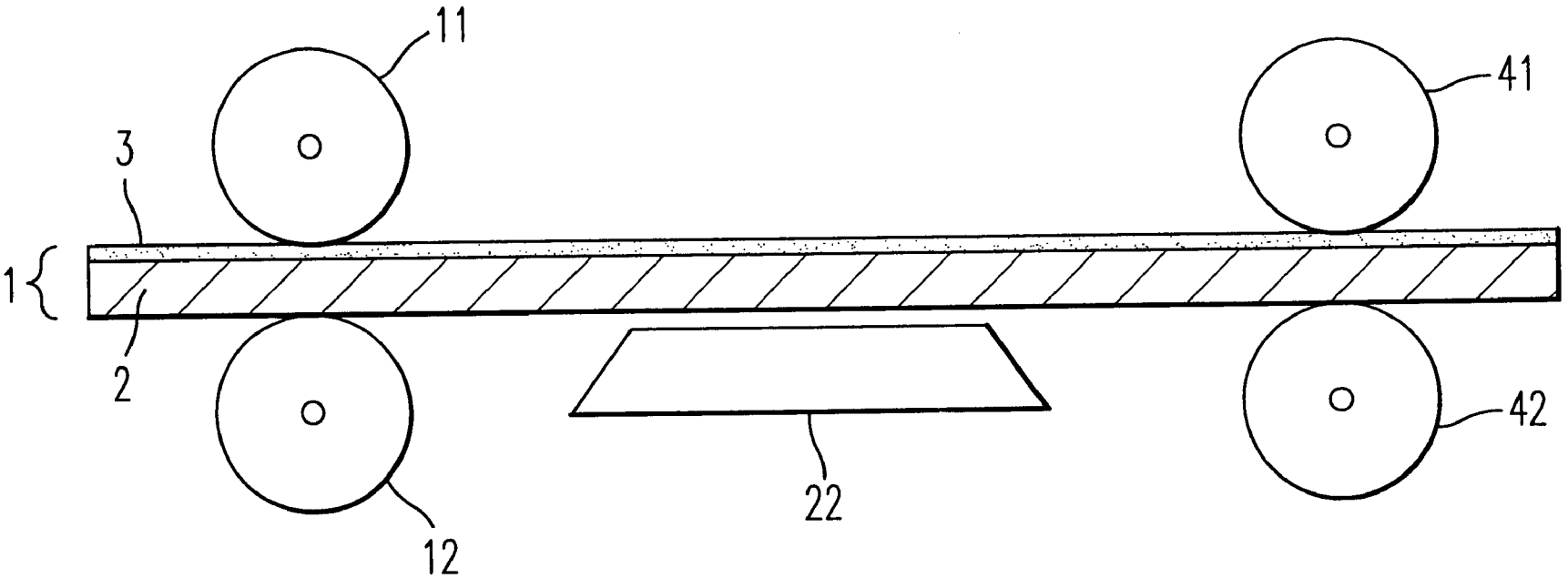
FIG. 3 is a schematic view illustrating an embodiment of the apparatus for preparing an ink jet printed product of the present invention (a heat conduction system).

Using an apparatus of FIG. 3, employing Example 12 (GO printed image) prepared as described above, a silk pattern surface printed product was prepared at a transport speed of 150 mm/min with the temperature of the lower heating panel 22 set to be 125° C., with the pressures of the patterned roller 41 and the press roller 42 set to be 60 g/mm, said patterned roller 41 being provided with a silk pattern engraving on its surface and being a fluorine-treated metal roll (surface temperature: 80° C.).

Ink Jet Printed Product A-4

Figure 4:
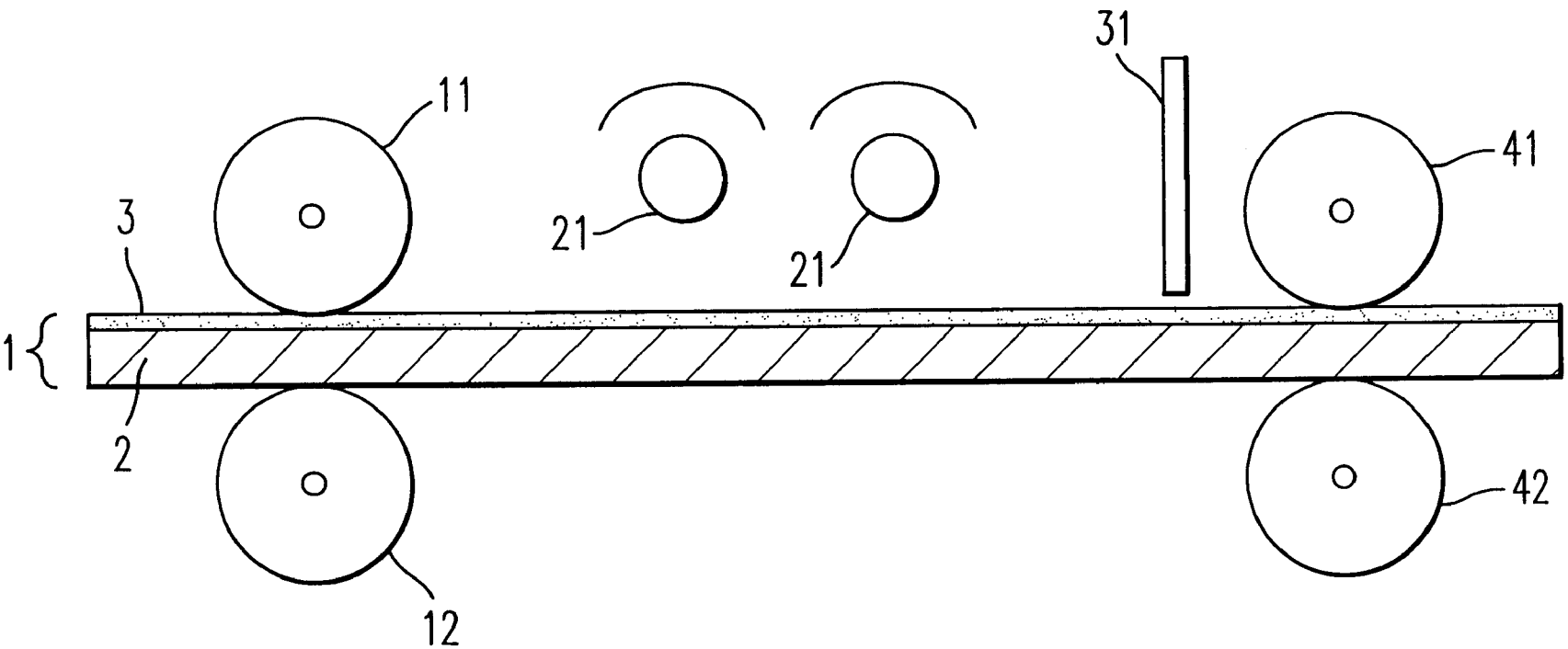
FIG. 4 is a schematic view illustrating an embodiment of the apparatus for preparing an ink jet printed product of the present invention (a radiation conduction system).

Using an apparatus of FIG. 4, employing Example 12 (GS printed image) prepared as described above, a printed product having a gloss surface was prepared at a transport speed of 500 mm/min with two upper heaters 21 switched on, with the pressures of the patterned roller 41 and the press roller 42 set to be 60 g/mm, said patterned roller 41 being a mirror-finished metal roll provided with chromium plating on its surface (surface temperature: 70° C.).

Ink Jet Printed Product A-5

Figure 5:
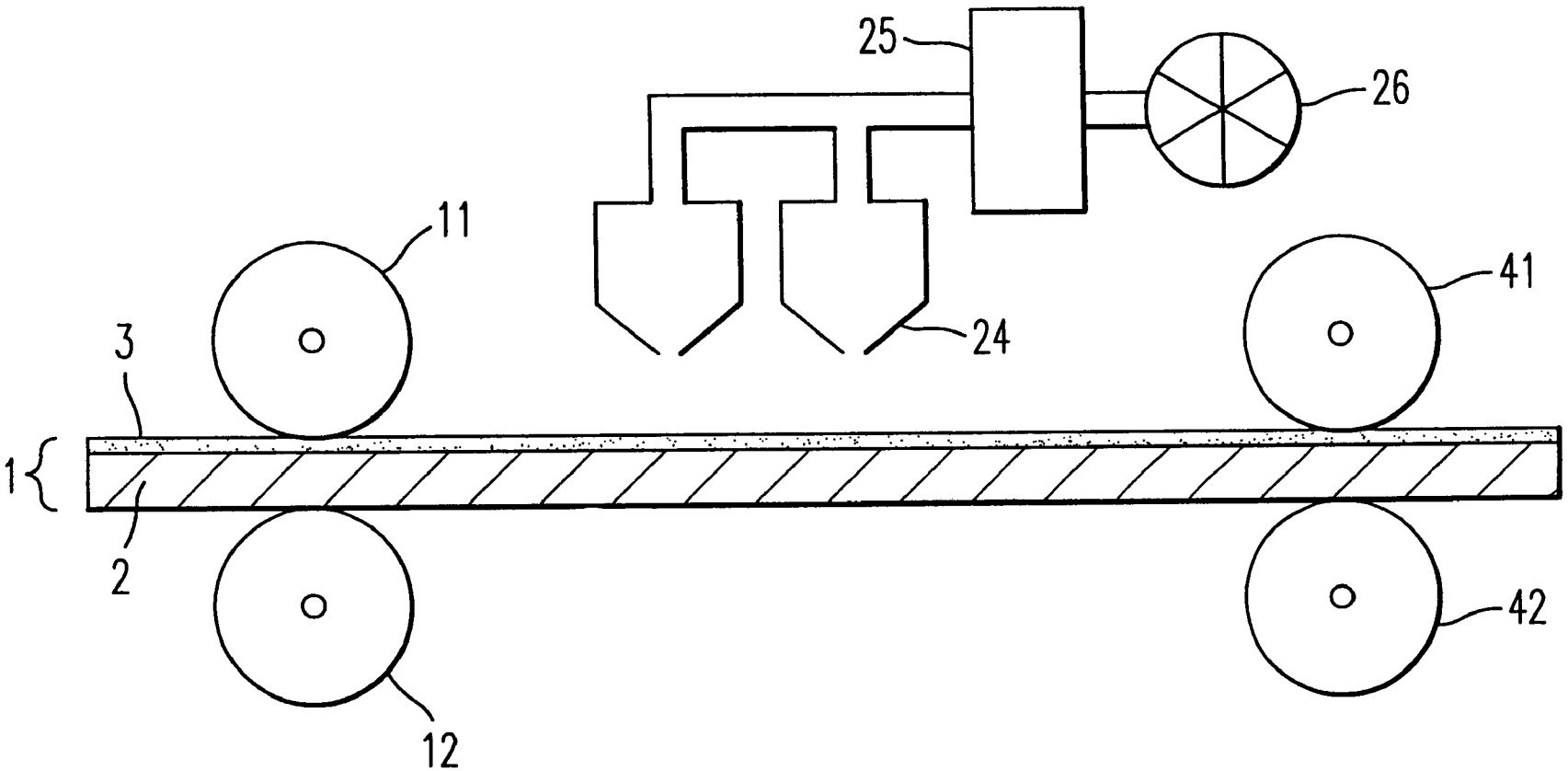
FIG. 5 is a schematic view illustrating an embodiment of the apparatus for preparing an ink jet printed product of the present invention (a convective heat transfer system).

Using an apparatus of FIG. 5 and employing Example 12 (GO printed image) prepared as described above, a printed product having a fine grain surface was prepared at a transport speed of 150 mm/min by jetting an air heated by a heater box 25 from an upper air nozzle 24 by an air blowing fan 26 (the air temperature was set to be 180° C.) with the pressures of the patterned roller 41 and the press roller 42 set to be 60 g/mm, said patterned roller 41 being a metal roll provided with a fine grain engraving on its surface (surface temperature: 50° C.).

Ink Jet Printed Product B-1

Using an apparatus of FIG. 1 and employing Example 13 (PM printed image) prepared as described above, a printed product having a gloss surface was prepared at a transport speed of 300 mm/min, with the upper heater 21 switched on, with the temperature of the lower heating panel 22 set to be 100° C., with the pressures of the patterned roller 41 and the press roller 42 set to be 50 g/mm, said patterned roller 41 being a metal roll having a mirror-finished surface (surface temperature: 80° C.).

Ink Jet Printed Product B-2

Using an apparatus of FIG. 2 and employing Example 13 (PM printed image) prepared as described above, a printed product having a mat surface was prepared at a transport speed of 300 mm/min, with the temperatures of the transporting and heating rollers 13 and 14 set to be 90° C., with the temperatures of the upper heating panel 23 and the lower heating panel 22 set to be 120° C., with the pressures of the patterned roller 41 and the press roller 42 set to be 50 g/mm, said patterned roller being a metal roll having a mat surface (surface temperature: 60° C.).

Ink Jet Printed Product B-3

Using an apparatus of FIG. 3 and employing Example 13 (PM printed image) prepared as described above, a printed product having a silk pattern surface was prepared at a transport speed of 150 mm/min with the temperature of the lower heating panel 22 set to be 125° C., with the pressures of the patterned roller 41 and the press roller 42 set to be 60 g/mm, said patterned roller being a fluorine-treated metal roll provided with a silk pattern engraving on its surface (surface temperature: 70° C.).

Ink Jet Printed Product B-4

Using an apparatus of FIG. 4 and employing Example 13 (PM printed image) prepared as described above, a printed product having a gloss surface was prepared at a transport speed of 500 mm/min with two upper heaters 21 switched on, with the pressures of the patterned roller 41 and the press roller 42 set to be 60 g/mm, said patterned roller 41 being a mirror-finished surface metal roll provided with chromium plating on its surface (surface temperature: 80° C.)

Ink Jet Printed Product B-5

Using an apparatus of FIG. 5 and employing Example 13 (PM printed image) prepared as described above, a printed product having a fine grain surface was prepared at a transport speed of 150 mm/min by jetting an air heated by a heater box 25 from an upper air nozzle 24 by an air blowing fan 26 (the air temperature was set to be 180° C.), with the pressures of the patterned roller 41 and the press roller 42 set to be 60 g/mm, said patterned roller 41 being a metal roll provided with a fine grain engraving on its surface (surface temperature: 80° C.).

Ink Jet Printed Product C-1

Using an apparatus of FIG. 1 and employing Example 14 (IP printed image) prepared as described above, a printed product having a gloss surface was prepared at a transport speed of 400 mm/min, with the upper heater 21 switched on, with the temperature of the lower heating panel 22 set to be 100° C., with the pressures of the patterned roller 41 and the press roller 42 set to be 50 g/mm, said patterned roller 41 being a metal roll having a mirror-finished surface (surface temperature: 100° C.).

Ink Jet Printed Product C-2

Using an apparatus of FIG. 2 and employing Example 14 (IP printed image) prepared as described above, a printed product having a mat surface was prepared at a transport speed of 300 mm/min, with the temperatures of the transporting and heating rollers 13 and 14 set to be 90° C., with the temperatures of the upper heating panel 23 and the lower heating panel 22 set to be 120° C., with the pressures of the patterned roller 41 and the press roller 42 set to be 50 g/mm, said patterned roller being a metal roll having a mat surface (surface temperature: 50° C.).

Ink Jet Printed Product C-3

Using an apparatus of FIG. 3 and employing Example 14 (IP printed image) prepared as described above, a printed product having a silk pattern surface was prepared at a transport speed of 150 mm/min with the temperature of the lower heating panel 22 set to be 125° C., with the pressures of the patterned roller 41 and the press roller 42 set to be 60 g/mm, said patterned roller being a fluorine-treated metal roll provided with a silk pattern engraving on its surface (surface temperature: 90° C.).

Ink Jet Printed Product C-4

Using an apparatus of FIG. 4 and employing Example 14 (IP printed image) prepared as described above, a printed product having a gloss surface was prepared at a transport speed of 500 mm/min with two upper heaters 21 switched on, with the pressures of the patterned roller 41 and the press roller 42 set to be 60 g/mm, said patterned roller 41 being a mirror-finished surface metal roll provided with chromium plating on its surface (surface temperature: 80° C.).

Ink Jet Printed Product C-5

Using an apparatus of FIG. 5 and employing Example 14 (IP printed image) prepared as described above, a printed product having a fine grain surface was prepared at a transport speed of 150 mm/min by jetting an air heated by a heater box 25 from an upper air nozzle 24 by an air blowing fan 26 (the air temperature was set to be 180° C.), with the pressures of the patterned roller 41 and the press roller 42 set to be 60 g/mm, said patterned roller 41 being a metal roll provided with a fine grain engraving on its surface (surface temperature: 80° C.).

Ink Jet Printed Product D-1

Using an apparatus of FIG. 1 and employing Example 15 (PM printed image) prepared as described above, a printed product having a gloss surface was prepared at a transport speed of 400 mm/min, with the upper heater 21 switched on, with the temperature of the lower heating panel 22 set to be 100° C., with the pressures of the patterned roller 41 and the press roller 42 set to be 50 g/mm, said patterned roller 41 being a metal roll having a mirror-finished surface (surface temperature: 100° C.).

Ink Jet Printed Product D-2

Using an apparatus of FIG. 2 and employing Example 15 (PM printed image) prepared as described above, a printed product having a mat surface was prepared at a transport speed of 300 mm/min, with the temperatures of the transporting and heating rollers 13 and 14 set to be 90° C., with the temperatures of the upper heating panel 23 and the lower heating panel 22 set to be 120° C., with the pressures of the patterned roller 41 and the press roller 42 set to be 50 g/mm, said patterned roller being a metal roll having a mat surface (surface temperature: 50° C.).

Ink Jet Printed Product D-3

Using an apparatus of FIG. 3 and employing Example 15 (PM printed image) prepared as described above, a printed product having a silk pattern surface was prepared at a transport speed of 150 mm/min, with the temperature of the lower heating panel 22 set to be 125° C., with the pressures of the patterned roller 41 and the press roller 42 set to be 60 g/mm, said patterned roller being a fluorine-treated metal roll provided with a silk pattern engraving on its surface (surface temperature: 70° C.).

Ink Jet Printed Product D-4

Using an apparatus of FIG. 4 and employing Example 15 (PM printed image) prepared as described above, a printed product having a gloss surface was prepared at a transport speed of 500 mm/min with two upper heaters 21 switched on, with the pressures of the patterned roller 41 and the press roller 42 set to be 60 g/mm, said patterned roller 41 being a mirror-finished surface metal roll provided with chromium plating on its surface (surface temperature: 80° C.).

Ink Jet Printed Product D-5

Using an apparatus of FIG. 5 and employing Example 15 (PM printed image) prepared as described above, a printed product having a fine grain surface was prepared at a transport speed of 150 mm/min by jetting an air heated by a heater box 25 from an upper air nozzle 24 by an air blowing fan 26 (the air temperature was set to be 180° C.), with the pressures of the patterned roller 41 and the press roller 42 set to be 60 g/mm, said patterned roller 41 being a metal roll provided with a fine grain engraving on its surface (surface temperature: 90° C.).

Ink Jet Printed Product E-1

Using an apparatus of FIG. 1 and employing Example 16 (PM printed image) prepared as described above, a printed product having a gloss surface was prepared at a transport speed of 400 mm/min, with the upper heater 21 switched on, with the temperature of the lower heating panel 22 set to be 100° C., with the pressures of the patterned roller 41 and the press roller 42 set to be 50 g/mm, said patterned roller 41 being a metal roll having a mirror-finished surface (surface temperature: 90° C.).

Ink Jet Printed Product E-2

Using an apparatus of FIG. 2 and employing Example 16 (PM printed image) prepared as described above, a printed product having a mat surface was prepared at a transport speed of 300 mm/min, with the temperatures of the transporting and heating rollers 13 and 14 set to be 90° C., with the temperatures of the upper heating panel 23 and the lower heating panel 22 set to be 120° C., with the pressures of the patterned roller 41 and the press roller 42 set to be 50 g/mm, said patterned roller being a metal roll having a mat surface (surface temperature: 50° C.).

Ink Jet Printed Product E-3

Using an apparatus of FIG. 3 and employing Example 16 (PM printed image) prepared as described above, a printed product having a silk pattern surface was prepared at a transport speed of 150 mm/min, with the temperature of the lower heating panel 22 set to be 125° C., with the pressures of the patterned roller 41 and the press roller 42 set to be 60 g/mm, said patterned roller being a fluorine-treated metal roll provided with a silk pattern engraving on its surface (surface temperature: 700C).

Ink Jet Printed Product E-4

Using an apparatus of FIG. 4 and employing Example 16 (PM printed image) prepared as described above, a printed product having a gloss surface was prepared at a transport speed of 500 mm/min with two upper heaters 21 switched on (the temperature in the vicinity of the thermoplastic organic polymer layer at that time was 150° C.), with the pressures of the patterned roller 41 and the press roller 42 set to be 60 g/mm, said patterned roller 41 being a mirror-finished surface metal roll provided with chromium plating on its surface (surface temperature: 1000C).

Ink Jet Printed Product E-5

Using an apparatus of FIG. 5 and employing Example 16 (PM printed image) prepared as described above, a printed product having a fine grain surface was prepared at a transport speed of 150 mm/min by jetting an air heated by a heater box 25 from an upper air nozzle 24 by an air blowing fan 26 (the air temperature was set to be 180° C.), with the pressures of the patterned roller 41 and the press roller 42 set to be 60 g/mm, said patterned roller 41 being a metal roll provided with a fine grain engraving on its surface (surface temperature: 80° C.).

As described in the foregoing, the ink jet printed product prepared by the treatment by means of the apparatus for preparing an ink jet printed product of the present invention, had a film on the surface free from defects of fine particles of a thermoplastic organic polymer as compared with the one treated by a laminator as sandwiched between polyester films, and was the one further improved in the water resistance. Further, it was an aesthetically excellent printed product having the surface shape of a patterned roll, such as a mirror surface, a mat surface, a silk pattern surface or a fine grain surface, precisely transferred, without sticking to the patterned roll of the preparation apparatus to cause surface roughening, or without distortion of the image.

According to the present invention, it is possible to provide an ink jet printed product excellent in all of the scratch resistance, light resistance, water resistance, gloss and avoidance of printing irregularities or bleeding.

Further, according to the treatment by the apparatus for preparing an ink jet printed product of the present invention, a film excellent in the water resistance can be formed on the surface, and at the same time, by transferring a pattern of the roll surface, the pattern can be impressed on the surface, to provide an aesthetically excellent ink jet printed product. Further, with the apparatus of the present invention, a sheet such as a film will not be present on the surface at the time of heating and melting the layer of fine particles of a thermoplastic organic polymer, the apparatus can be made compact and free from a trouble by the presence of such a sheet.

What is claimed is:

1. An ink jet recording medium which comprises a support and a layer comprising fine particles of a thermoplastic organic polymer formed on at least one side of the support, so that said fine particles of a thermoplastic organic polymer are dissolved or melted after ink jet recording to form a layer wherein said fine particles of a thermoplastic organic polymer are fused to one another, wherein:

(1) an ink-absorbing layer comprising an inorganic pigment is formed between the support and the layer comprising fine particles of a thermoplastic organic polymer, (2) said fine particles of a thermoplastic organic polymer have an average particle size within a range of from 1 to 20 $\mu$m, and (3) said inorganic pigment comprises a pigment having an average secondary particle size of at least 1 $\mu$m and less than 5 $\mu$m and a pigment having an average secondary particle size of at least 5 $\mu$m.

2. The ink jet recording medium according to claim 1, wherein the layer comprising fine particles of a thermoplastic organic polymer, contains colloidal silica.

3. The ink jet recording medium according to claim 1, wherein the layer comprising fine particles of a thermoplastic organic polymer, contains a release agent.

4. The ink jet recording medium according to claim 1, wherein said fine particles of a thermoplastic organic polymer are of a polyolefin resin.

5. The ink jet recording medium according to claim 1, wherein the support is a waterproof support.

6. An apparatus for preparing an ink jet printed product, whereby, after carrying out ink jet recording on an ink jet recording medium which comprises a support and a layer comprising fine particles of a thermoplastic organic polymer, formed on at least one side of the support, said fine particles of a thermoplastic organic polymer are dissolved or melted to form a layer wherein said fine particles of a thermoplastic organic polymer are fused to one another, which comprises a step of heating the layer comprising fine particles of a thermoplastic organic polymer, and an impressing step of passing the recording medium between a pair of press rolls while the layer comprising fine particles of a thermoplastic organic polymer is still in a plastic state after the heating step, to transfer a shape of the roll surface to the layer.

7. The apparatus for preparing an ink jet printed product according to claim 6, wherein the temperature of the roll surface which contacts the layer comprising fine particles of a thermoplastic organic polymer in the impressing step, is lower than the temperature in the heating step.

8. The apparatus for preparing an ink jet printed product according to claim 6, wherein the heating step is a step of heating to a temperature of at least the minimum film-forming temperature (MFT) of said fine particles of a thermoplastic organic polymer, and the temperature of the roll surface in the impressing step is a temperature lower than MFT.

9. The apparatus for preparing an ink jet printed product according to claim 6, wherein the heating means in the heating step is of a type to heat from the rear side of the support by a heat conduction system.

10. The apparatus for preparing an ink jet printed product according to claim 6, wherein the heating means in the heating step is of a type to heat from the side of the layer comprising fine particles of a thermoplastic organic polymer by a radiation conduction system.

11. The apparatus for preparing an ink jet printed product according to claim 6, wherein the heating means in the heating step is of a type to heat from the side of the layer comprising fine particles of a thermoplastic organic polymer by a convective heat transfer system.

12. The apparatus for preparing an ink jet printed product according to any one of claim 6, wherein the roll surface which contacts the layer comprising fine particles of a thermoplastic organic polymer in the impressing step, is a mirror-finished surface, a roughened surface or a surface having a patterned engraving.

13. An ink jet printed product obtained by carrying out ink jet recording on an ink jet recording medium which comprises a support and a layer comprising fine particles of a thermoplastic organic polymer, formed on at least one side of the support, so that said fine particles of a thermoplastic organic polymer are dissolved or melted after ink jet recording to form a layer wherein said fine particles of a thermoplastic organic polymer are fused to one another, wherein said fine particles of a thermoplastic organic polymer have an average particle size within a range of from 1 to 20 $\mu$m, followed by treatment by an apparatus for preparing an ink jet printed product as defined claim 6.

* * * * *

UNITED STATES PATENT AND TRADEMARK OFFICE

CERTIFICATE OF CORRECTION

PATENT NO. : 6,357,871 B1
DATED : March 19, 2002
INVENTOR(S) : Ashida et al.

It is certified that error appears in the above-identified patent and that said Letters Patent is hereby corrected as shown below:

Title page,
Item [30], Foreign Application Priority Data, should read as follows:

-- [30] Foreign Application Priority Data
Nov. 27, 1998 (JP) ..... 10-336877
Jan. 13, 1999 (JP) ..... 11-006001
Jan. 13, 1999 (JP) ..... 11-006002
Jan. 14, 1999 (JP) ..... 11-007903 --

Signed and Sealed this

Seventeenth Day of September, 2002

*Attest:*

*Attesting Officer*

JAMES E. ROGAN
*Director of the United States Patent and Trademark Office*